US005240110A

United States Patent [19]

Reichenbach, III et al.

[11] Patent Number: 5,240,110

[45] Date of Patent: Aug. 31, 1993

[54] PACKAGE WITH WINDOWS AND SHELL SECURED TO THE BACK SIDE OF A CARD

[75] Inventors: Carl F. Reichenbach, III, Altamonte Springs; Robert M. Witt, Casselberry, both of Fla.

[73] Assignee: Dixon Ticonderoga Company, Maitland, Fla.

[21] Appl. No.: 892,937

[22] Filed: Jun. 3, 1992

[51] Int. Cl.[5] ..... B65D 73/00

[52] U.S. Cl. ..... 206/462; 206/45.31; 206/457; 206/459.5

[58] Field of Search ..... 206/461, 462, 464–471, 206/45.31, 45.33, 495, 459.5, 457

[56] References Cited

U.S. PATENT DOCUMENTS

| | | | |
|---|---|---|---|
| 2,931,494 | 4/1960 | Pfohl | 206/462 |
| 2,931,495 | 4/1960 | Stratton, Jr. | 206/462 |
| 2,945,586 | 9/1960 | Mackes . | |
| 3,076,542 | 2/1963 | Lowry et al. | 206/471 |
| 3,127,010 | 3/1964 | Capezzuto | 206/45.31 X |
| 3,346,108 | 10/1967 | Wizelman | 206/469 |
| 3,476,239 | 9/1967 | Jacob . | |
| 3,764,002 | 10/1973 | Spregel et al. | 206/471 X |
| 3,948,391 | 4/1976 | Beaman | 206/461 X |
| 4,096,945 | 6/1978 | Melton, Jr. et al. . | |
| 4,200,193 | 4/1980 | Boyle | 206/461 |
| 4,266,667 | 5/1981 | Ishigaki . | |
| 4,669,610 | 6/1987 | Lindsey et al. . | |
| 4,872,551 | 10/1989 | Theros . | |

FOREIGN PATENT DOCUMENTS

| | | | |
|---|---|---|---|
| 671006 | 9/1963 | Canada | 206/471 |
| 2124931 | 5/1971 | Fed. Rep. of Germany . | |
| 1065981 | 4/1967 | United Kingdom | 206/462 |

*Primary Examiner*—Bryon P. Gehman

*Attorney, Agent, or Firm*—Fitzpatrick, Cella, Harper & Scinto

[57] ABSTRACT

A shell made of a plastic sheet having a top wall, a bottom wall, a plurality of side walls and a rear supporting wall forming the shape of a pocket, one or more articles that fit within the pocket, a card having a front side and a back side, and said shell is secured to the back side of the card with articles in the pocket so that said articles are recessed in relationship to the front side of the card. Said card having one or more windows which expose the articles in the shell and permit the prospective purchase to touch the articles.

13 Claims, 1 Drawing Sheet

PACKAGE WITH WINDOWS AND SHELL SECURED TO THE BACK SIDE OF A CARD

BACKGROUND OF THE INVENTION

The present invention relates to a novel package, more particularly to a package where a shell is secured to the back or rear side of a card that has windows which permit the objects contained in the package to be visually inspected and touched by a prospective purchaser but yet prevent such packaged object from being withdrawn from the package through the window.

Typical package containers have a paperboard card and a transparent thermoplastic film, or plastic sheet, that is molded or shaped to conform with the object contained. With these packages, sometimes referred to as "blister" packages, the contents are inaccessible in that they project outwardly from the front of the paperboard card and are completely encased by the plastic shell. With traditional blister packages the contents of the package are in front of the paperboard card which also creates difficulties with the graphics used in displaying the package.

Alternative blister type packages include clamshell packages made out of plastic sheets which conform closely to the shape of the article being packaged. These types of blister packages can be constructed so they are reusable and allow the purchaser to place the contents back into the package for storage. Unlike blister packages made with a paperboard card, with these packages the contents of the package is normally completely visible to the purchaser.

U.S. Pat. No. 3,476,239 discloses a blister package that uses a plastic sheet and a paperboard card where a blister shell is premolded by thermo-forming techniques so the plastic conforms to the article being packaged. According to the specification, the blister shell is sealed to the front of a paperboard card. The paperboard card is disclosed as being coated with a heat-activatable adhesive printing ink to prevent smudging of the graphics on the paperboard card and to insure that a good adhesive bond remains between the paperboard card and the blister shell. With this type of blister package the contents project outwardly from the front of the paperboard card when displayed and it does not allow the prospective purchaser to handle the articles contained in the package.

U.S. Pat. No. 2,945,586 discloses a completely transparent reclosable blister package for containing markers and crayons. According to the specification, this blister package allows the prospective purchaser to view and inspect the contents of the package in its entirety without opening the container. This blister package, likewise, does not allow the prospective purchaser to handle the articles packaged without opening the package. Moreover, this type of package usually requires a paper insert to provide the graphic design for the display package. When paper inserts are used the graphics designs usually appear only as two dimensional figures. U.S. Pat. No. 4,872,551 discloses a transparent plastic clamshell blister package is made of mirror image plastic panels for pliers or similar hand tools. This package, as shown in the specification, is designed so a prospective purchaser can operate the handles of the tool while the teeth or upper portion of the pliers or hand tool remain in the clamshell shaped blister package. This patent also discloses the use of an information card that is inserted within the clamshell blister package which has the same limitations as stated above.

None of the above cited references disclose a package that features the combined advantages of having articles in a shell or pocket secured to the back side of a card with windows such that the articles contained therein can be seen and touched by the prospective purchaser through the windows, eliminating the need for a paper insert, and permitting the card to have graphic designs of three dimensional like figures that are prominently displayed.

BRIEF DESCRIPTION OF THE INVENTION

The present invention comprises a novel package where the contents displayed are contained in a shell which is secured to the back side of a card having windows. A package of this type can be used for writing instruments or drawing instruments such as pencils, pens, crayons or markers, or other articles of the similar size, and is constructed so a prospective purchaser can both visually inspect the majority of the articles contained within the package and can also touch the contents of the package.

The package has a shell that conforms and contains the articles displayed. The shell, sometimes referred to as a "blister shell", is typically constructed with a transparent plastic sheet formed generally in the shape of a pocket. The shell need not be limited to plastic, thermoplastic film or other material similar to plastic can be used to construct the shell. After the contents of the package are placed in the pocket of the shell, the shell is then secured to the back side of a card.

The card, usually made of paperboard material, has at least one window so that the contents of the package are exposed and can be touched by the prospective purchaser. The windows can be "die-cut" into the desired shape, however, any other means for creating a window can be used.

The windows can be shaped so the card contains a graphic design that is consistent with a marketing concept and reveals a story for the product being displayed. For instance, if the contents of the package are pencils with pre-historic animals on them, then the windows could be shaped in the figure of a dinosaur or the card could have a design on it in conjunction with the windows that creates the figure of a dinosaur. Furthermore, the dinosaur shape could be perforated so that the dinosaur can be disassembled and removed from the package after the contents are purchased.

OBJECTS OF THE INVENTION

One object of the present invention is to provide a novel display package that utilizes a shell that is recessed and secured to the back side of a card that has one or more windows.

Another object of the present invention is to provide a novel display package where the contents packaged can be visually inspected from the front of the display package and can be touched by the prospective purchaser.

Still another object of the present invention is to provide a novel display package that the contents are incased from the rear and graphics of the display package can be prominently displayed on a card without interference by the contents.

Still another object of the present invention is to provide a novel display package which utilizes windows to form a figure on the card which is three dimensional in appearance and is consistent with a marketing concept.

The above as well as other objects of the present invention will become apparent when reading the accompanying description and drawings.

DETAILED DESCRIPTION OF THE INVENTION

Figure 2:
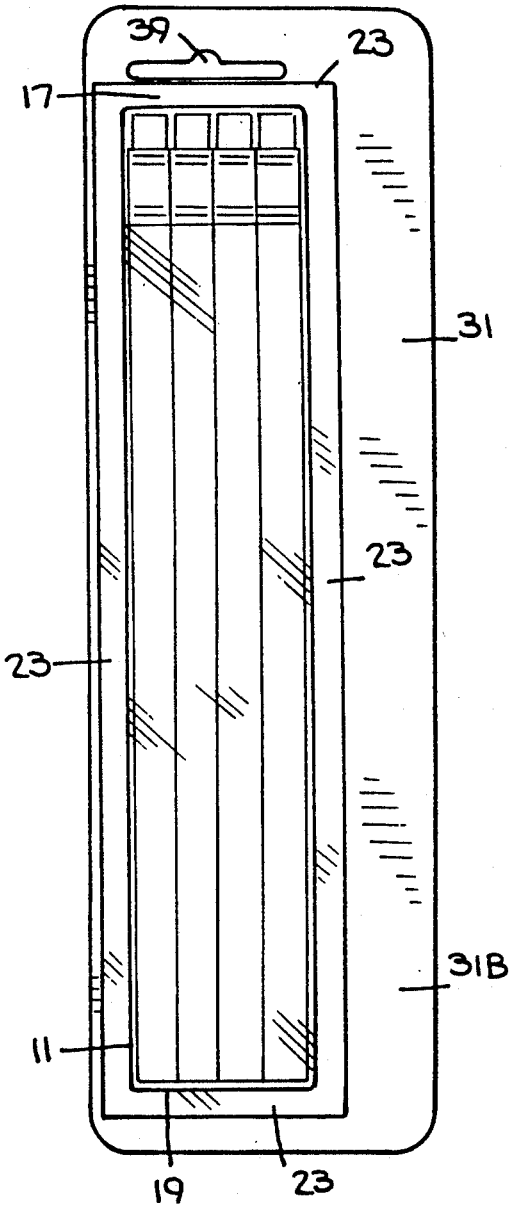
FIG. 2 shows a perspective rear view of the package in FIG. 1.

Referring now to all the drawings, there is shown a package 10 with a shell 11 having two sidewalls 13 and 15, a top wall 17, bottom wall 19, and a rear supporting wall 21. These adjoining walls form a pocket 22 that conforms to the articles contained within the package. As shown in FIG. 2, the preferred embodiment has flanges 23 extend outwardly and perpendicularly from the side walls 13, 15, top wall 17 and bottom wall 19 of the shell 11. The shell 11 is usually made of transparent plastic sheets, however, any color plastic or even opaque plastic can be used.

Figure 1:
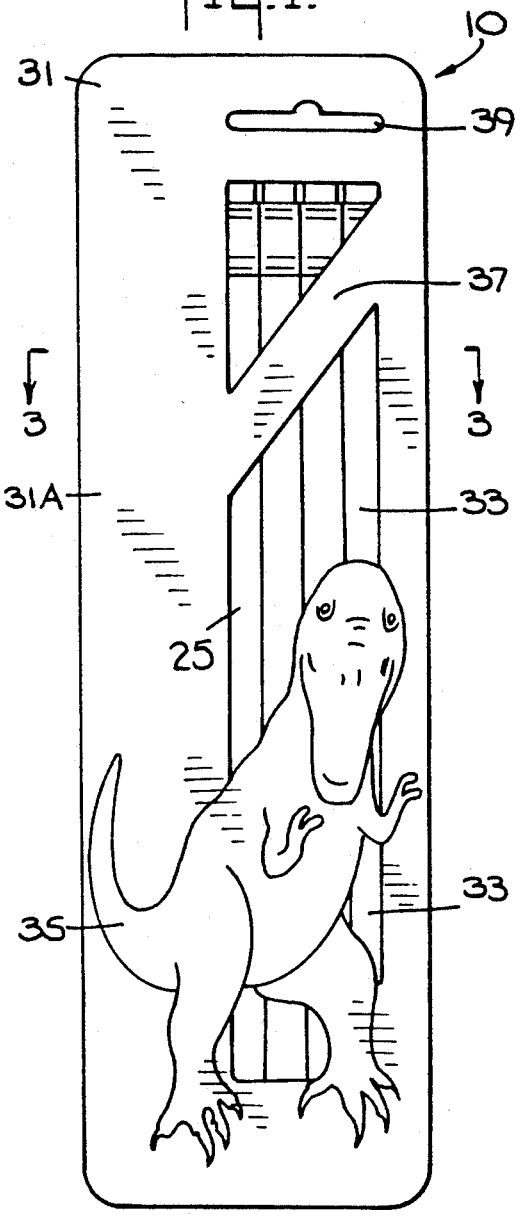
FIG. 1 shows a perspective front view of a package designed in accordance with the principles of the present invention.
Figure 3:
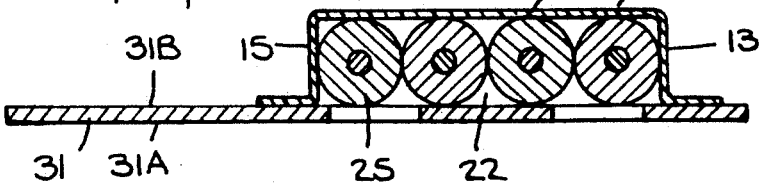
FIG. 3 shows a horizontal view of the package in FIG. 1.

FIGS. 1 and 3 show four pencils 25 in the pocket 22 of the shell 11. The rear supporting wall 21 can be curved to conform with the size and shape of the pencils 25 placed in the shell 11. FIG. 2 shows the shell 11, with the pencils 25 in the pocket 22, affixed at the flanges 23 to the back side of a card 31. Although flanges glued to the card 31 are used in the preferred embodiment to secure the shell 11 to the card 31, the invention is not so limited to this means and any other suitable adhering or affixing means can be utilized to secure the shell to the card, including securing means that allows the articles to be returned to the package for storage.

In the preferred embodiment the card 31 is made of paperboard. However, plastic, metal or other materials that are generally rigid can be used. The card 31 has a front side 31A shown at FIG. 1 and back side 31B shown at FIG. 2. The back side 31B is usually a plain color since when displayed it is not seen by the purchaser. However, the front side 31A provides a distinctive graphic design that contains a story which is consistent with the marketing strategy of the package and attractive to the prospective purchaser.

As part of the distinctive design the card 31 has windows 33, which as shown in FIG. 1 assist in forming the shape of a figure which is displayed. Although the invention contemplates using "die cuts" to make the windows any suitable means for cutting windows is acceptable. Also, the distinctive figure could be made utilizing only windows without extending onto the card. As shown in FIG. 1 the distinctive figure can be a dinosaur 35 which is prominently displayed on the card 31. This figure can be highlighted by using contrasting colors between the dinosaur 35 and the background of the front side of card 31A.

Moreover, the dinosaur character 35 in the card 31 can be perforated such that when the pencils are removed from the blister shell 11 the dinosaur 35 can be detached from the card and used as a play toy or poster.

As readily observed from FIG. 1, an advantage of having the contents behind the card is that there is no need to use an information sheet within the package since the card shows all the graphics necessary for the package. Also, use of the card in this way eliminates difficulties in selecting inks that will not smudge when the blister shell is secured to the card. Moreover, the contents of the package do not interfere with the graphics of the package.

The windows 33 can form a distinctive banner 37 that transverses the windows 33 and prevents the contents of the package from being removed or falling out. The distinctive banner 37 can be used for containing additional graphics which highlight aspects of the articles packaged. Also, a display cut-out 39 can be used to facilitate hanging the package from a display stand.

In an alternative embodiment, the shell can be made using a thermoplastic film which is heat shrunk around articles contained within the package. Display packages of this type are sometimes referred to as "skin packs" or "shrink wrap packages." These packages are substantially similar to the package using a plastic shell except the pocket material is less rigid than used in a plastic shell package. As indicated above, the shell of the package can be made of other material similar to plastic or thermoplastic film.

While particular embodiments of the blister package with windows has been shown, it will be appreciated by those skilled in the art that modifications may be made without departing from the invention in its broader aspects and as set forth in the following claims.

What is claimed is:

1. A blister package for containing and displaying articles comprising:

a shell made of a plastic sheet having a top wall, a bottom wall, a plurality of side walls and a rear wall;

one or more articles that fit within and are substantially enclosed by the shell;

a card having a front side and back side, where the front side of the card has a distinctively-shaped graphic figure representing a character, said shell is secured to the back side of the card such that the shell and one or more articles within the shell are recessed in relationship to the front side of the card;

said card having one or more windows defined therethrough which expose said one or more articles within the shell and permit a prospective purchaser to touch one or more articles within the shell and where the shape of said one or more windows assist in forming the distinctively-shaped graphic figure representing a character on the front side of the card.

2. A package of claim 1, wherein said distinctively-shaped graphic figure representing a character is perforated to facilitate removal from the card.

3. A package of claim 1, wherein the card is made of paperboard.

4. A package of claim 1, wherein the one or more articles placed in the shell are writing instruments or drawing instruments.

5. A package of claim 1, wherein a distinctive banner traverses one or more windows.

6. A package of claim 1, wherein the card is made of plastic.

7. A blister package for containing and displaying articles comprising:

a thermoplastic film that encases one or more articles, said thermoplastic film forms to the shape of the one or more articles encased;

a card having a front side and a back side, where the front side of the card has a distinctively-shaped graphic figure representing a character, said thermoplastic film is secured to the back side of the card such that the one or more articles encased are recessed from the front side of the card;

said card having one or more windows defined therethrough which expose one or more articles encased by the thermoplastic film and permit one or more articles within the shell to be touched by the prospective purchaser;

the shape of said one or more windows assist informing the distinctively-shaped graphic figure representing a character on the front side of the card.

8. A package of claim 7, wherein said distinctively-shaped graphic figure representing a character is perforated to facilitate removal from the card.

9. A package of claim 7, wherein the card is made of paperboard.

10. A package of claim 7, wherein the one or more articles encased by the thermoplastic film are writing instruments or drawing instruments.

11. A package of claim 7, wherein a distinctive banner traverses a window.

12. A package of claim 7, wherein the card is made of plastic.

13. A blister package for containing and displaying writing instruments or drawing instruments comprising:

a shell made of a transparent plastic sheet having a recessed pocket and a means for securing the shell to a paperboard card;

said recessed picket conforms to one or more articles that are placed in the recessed pocket;

said paperboard card having a front said and a back side with a distinctively-shaped graphic figure representing a character on the front side and one or more windows defined through the paperboard card;

said shell is secured to the back side of the paperboard card with the articles in the recessed picket, and one or more articles can be touched through the one or more windows by a prospective purchaser;

the shape of said one or more windows assist in forming the distinctively-shaped graphic figure representing a character on the front side of the card.

* * * * *